US006430944B1

(12) United States Patent
Ozawa

(10) Patent No.: US 6,430,944 B1
(45) Date of Patent: Aug. 13, 2002

(54) REMOTE MAINTENANCE SYSTEM AND METHOD FOR CHILLER UNITS

(75) Inventor: Toru Ozawa, Tustin, CA (US)

(73) Assignee: SMC Kabushiki Kaisha, Tokyo (JP)

( * ) Notice: Subject to any disclaimer, the term of this patent is extended or adjusted under 35 U.S.C. 154(b) by 53 days.

(21) Appl. No.: 09/833,760

(22) Filed: Apr. 13, 2001

(51) Int. Cl.[7] ..... F25B 1/00

(52) U.S. Cl. ..... 62/115; 62/129; 165/11.1; 236/51

(58) Field of Search ..... 62/127, 129, 115, 62/183; 236/51, 94; 165/11.1

(56) References Cited

U.S. PATENT DOCUMENTS 5,083,438 A * 1/1992 McMullin ..... 62/115
5,115,643 A * 5/1992 Hayata et al. ..... 62/129
5,457,963 A * 10/1995 Cahill-O'Brien et al. ..... 62/127
5,651,264 A * 7/1997 Lo et al. ..... 62/230
5,746,062 A * 5/1998 Beaverson et al. ..... 62/129
5,803,357 A * 9/1998 Lakin ..... 236/78 B X
6,241,155 B1 * 6/2001 Weng ..... 236/51

* cited by examiner

*Primary Examiner*—William E. Tapolcal
*Assistant Examiner*—Mohammad M Ali
(74) *Attorney, Agent, or Firm*—Paul A. Guss

(57) ABSTRACT

A refrigerant gas leak is detected using remote maintenance technology, for chiller units installed in a substantially constant temperature industrial setting, where the influence of environmental temperature is largely constant and therefore can be accounted for in a predictable way. A simple and low cost method of detecting or predicting a refrigerant gas leak is proposed, on the basis of a relationship between evaporation temperature and at least one of atmospheric temperature, condenser cooling water temperature or refrigerant condensing temperature. Thus, a refrigerant gas leak can be detected on the basis of the evaporation temperature taking into account the effect of atmospheric temperature.

14 Claims, 5 Drawing Sheets

REMOTE MAINTENANCE SYSTEM AND METHOD FOR CHILLER UNITS

BACKGROUND OF THE INVENTION

1. Field of the Invention

The present invention concerns a system and method for monitoring the performance of remote factory located chiller units, and in particular, to a system and method which enable the precognition of a refrigerant leak, or insufficiency of a refrigerant, in the refrigeration circuit of chiller units, for enabling preventative maintenance to be performed thereon.

2. Description of the Related Art

Systems for performing remote maintenance on various types of industrial equipment are known. Remote maintenance technology is a technique for monitoring operation and predicting problems of equipment located at customer sites from a monitoring and maintenance facility, thus allowing one to obtain equipment operating data. In such systems, various operational parameters of the equipment installed in remote locations are sensed and transmitted in digital form over a network to a server monitoring and maintenance facility. At the server monitoring and maintenance facility, the parameters are collected and monitored over time and, on the basis of various protocols, if one or more of the sensed parameters suggests a current or potential future malfunction in the equipment, maintenance staff can be dispatched to the remote locations where the equipment is located, in order to effect repairs, perform routine maintenance, and the like. One particular type of industrial equipment which is widely used is known as a"chiller" unit. The outer aspect of a known type of chiller unit is shown in FIG. 1. The chiller unit 10 is basically a portable refrigeration unit having a refrigeration circuit through which a refrigerant gas medium such as R134a, R22, R404A, or the like, is circulated in a known manner. In addition to the refrigeration circuit, a cooling medium, usually water, is circulated both internally and externally of the chiller unit 10 through a cooling medium circulating circuit, wherein the cooling water undergoes thermal exchange with the refrigeration circuit for cooling the water. The cooled water is then pumped centrifugally out of the chiller unit 10 through a cooling conduit making up the external part of the cooling medium circulating circuit. More specifically, respective ends of the cooling conduit are connected to cooling medium inlet and outlet connections 20 and 30 on the chiller unit 10, wherein the cooling medium circulating conduit is installed in a circuitous pattern throughout the location where it is necessary to maintain a predetermined cooled condition, such as in semiconductor manufacturing chambers, computer hardware installations, or any other type of equipment for which controlled cooling is required. The chiller unit 10, as shown in FIG. 1, includes various controls and/or indicator lights (generally designated at 40) thereon for controlling chiller operation. The operating temperature of the cooling medium produced from chiller unit may be displayed using a gauge 70. Such chiller units 10 are generally portable via casters 50 and are intended to be located in close proximity to the customer facility in which the cooling conduits are installed and used, the units being fixed in place by adjustable positioning feet 60.

A typical maintenance problem with any refrigeration circuit, including the above-described chiller units, is that of refrigerant gas leakage. In the context of chiller units, the most serious problem, of course, is when the unit fails to cool properly, and refrigerant gas leakage is one of the primary causes for failure to cool. The demands of precision manufacturing, such as in semiconductor production facilities, require precise and unfailing temperature controls. Unfortunately, it is generally difficult to effectively diagnose problems of refrigerant gas leakage.

Currently, two methods are used to detect refrigerant gas leakage in chiller units. The first is to directly trace the gas leak using a refrigerant gas leakage detector. Secondly, it is possible to diagnose gas leakage by reading the refrigerant gas pressure. Both of these methods have disadvantages. Namely, the detecting devices tend to be expensive. In addition, the devices must be used at the location of the chiller unit in order to directly detect a leak or to detect refrigerant gas pressure. Such devices are not easily capable of transmitting the detected data to other locations. Moreover, such devices, while useful for detecting the source of a refrigerant gas leak, do not enable ongoing observation of a refrigeration circuit in such a way as to enable predictive maintenance to be performed, namely, to tell when a refrigerant gas leak or insufficiency of refrigerant is likely to happen, and perform the necessary preventative maintenance to correct the problem. before it becomes serious.

The temperature in connection with the evaporator in a refrigeration circuit has been measured as a method for detecting insufficiency of the refrigerant. Prior art references which employ such methods, in various forms, shall be discussed below. Typically such systems have been proposed primarily for use in automobiles.

Japanese Laid-Open Application No. 63-32271 proposes that the evaporation temperature of a refrigerant medium should be detected before and after starting a compressor, wherein a gas leak can be detected by comparing such values.

Japanese Laid-Open Application No. 63-135761 discloses the use of an electrical expansion valve, wherein a refrigerant medium gas leak is detected from a relationship between an opening degree of the expansion valve and the evaporation temperature.

Japanese Laid-Open Application No. 63-238364 proposes sensing the evaporator outlet temperature at a time when the compressor is halted, for detecting a refrigerant medium gas leakage.

U.S. Pat. No. 5,150,584 to Tomasov et al. discloses detecting a refrigerant medium gas leak from a relationship between inlet evaporation temperature and the outlet evaporation temperature of an evaporator, and the compressor surface temperature.

U.S. Pat. No. 5,301,514 to Bessler et al. discloses detecting a refrigerant medium gas leak from a relation between an expansion pressure valve opening degree and evaporation temperature.

U.S. Pat. No. 5,713,213 to Nobuta et al. uses not only evaporation temperature but also a relationship with the halted state of the compressor for accurate detection of a refrigerant medium leak.

Finally, German Patent Document DE 3 913 521 by Hemm discloses detecting a refrigerant medium gas leak by means of a calculation using the compressor inlet refrigerant medium pressure and refrigerant medium temperature.

The above known techniques, although suggesting a relationship of evaporation temperature with a refrigerant gas leak, nevertheless possess important differences which make them impractical for use in a remote factory installed environment which is an indispensable requirement of the above-described chiller unit. In particular, since these known techniques are primarily intended for use in automobiles, a continuous time-based monitoring of parameters is not readily possible. Moreover, because an automobile encounters all kinds of environmental changes in temperature, humidity and the like, it is difficult to reliably detect an evaporation temperature that is not influenced by environmental conditions, and reliably determining temperature changes in the evaporation temperature alone, not affected by environmental conditions, is difficult if not impossible in an automotive situation.

SUMMARY OF THE INVENTION

In contrast to the prior techniques discussed above, the present invention has an object of detecting a refrigerant leak using remote maintenance technology, for chiller units that are disposed in a substantially constant temperature factory setting, where the influence of environmental temperature is largely constant and therefore can be accounted for in a predictable way. Therefore, the present invention enables a simple and low cost method of detecting or predicting a refrigerant gas leak, on the basis of a relationship between the evaporation temperature and at least one of 1) atmospheric temperature in the vicinity of a condenser, 2) condenser cooling water temperature, or 3) the temperature of the refrigerant as it passes through the condenser (i.e., refrigerant condensing temperature), in a refrigeration circuit. Stated otherwise, the present invention enables a refrigerant gas leak to be reliably detected on the basis of the evaporation temperature while understanding the relationship thereof to atmospheric temperature, condenser cooling water temperature and/or refrigerant condensing temperature, using a simple thermocouple or other temperature detecting means, thereby lowering cost.

A further object of the present invention is to enable chiller units to be monitored continuously using remote maintenance technology, with the aim of predicting an incipient refrigerant gas leak using a relationship between evaporator temperature and the quantity of refrigerant which circulates in the refrigeration circuit. Data on the evaporation temperature, detected using the simple thermocouple means described in the preceding paragraph, along with at least one of atmospheric temperature, condenser cooling water temperature or refrigerant condensing temperature, is sampled periodically and transmitted over a network (such as the Internet or an intranet, by electronic mail, telephone lines or any other means for enabling data transmission) to a monitoring and servicing facility. Analysis of the data at the monitoring and servicing facility is performed on a periodic time basis to detect a refrigerant gas leak, and when so detected, maintenance personnel can be dispatched to the remote factory location for servicing or repair of the chiller units.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
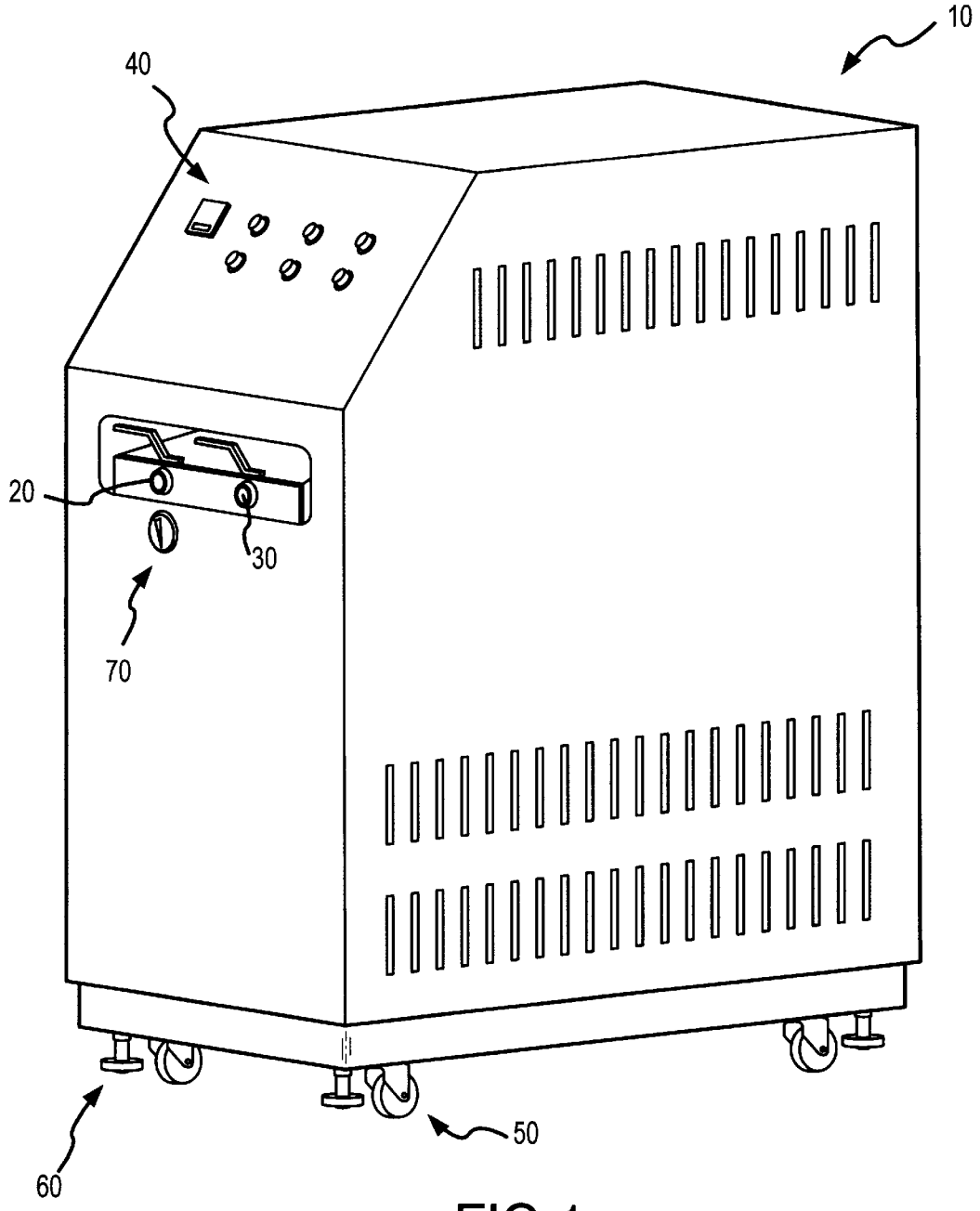
FIG. 1 shows the external aspect of a known type of chiller unit which is installable in a remote factory location.
Figure 2:
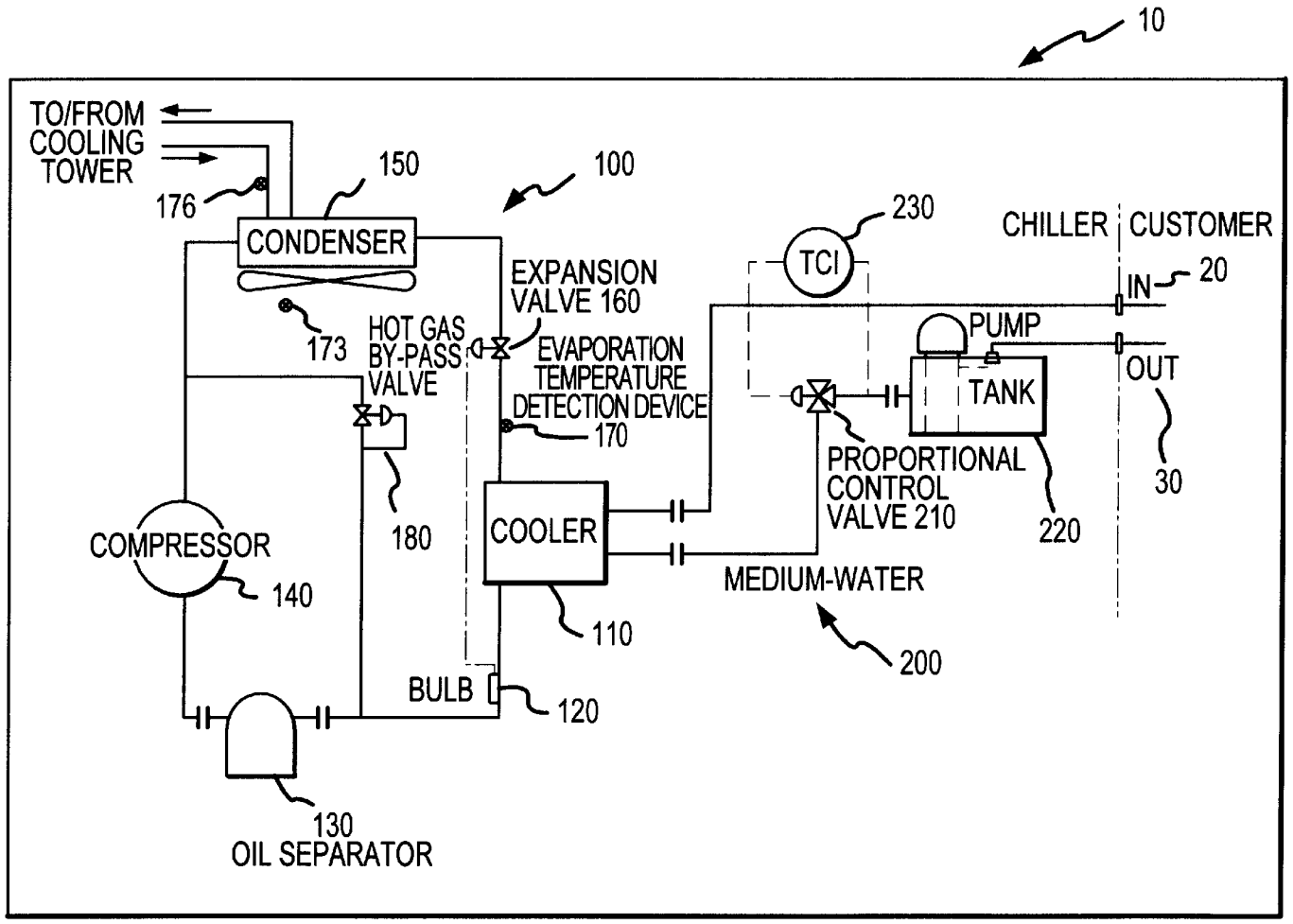
FIG. 2 illustrates in schematic form a device configuration and internal elements of the chiller unit shown in FIG. 1, including means for detecting evaporation temperature in accordance with the principles of the present invention.

A device configuration describing the internal elements of a chiller unit 10, such as the unit shown in FIG. 1, and including means for detecting evaporation temperature therein, shall be explained in connection with FIG. 2.

As discussed above, the chiller unit 10 is basically a refrigeration unit having a refrigeration circuit 100 through which a refrigerant gas medium, such as R134a, R22, R404A, or the like, is circulated in a known manner. In addition to the refrigeration circuit 100, a second medium, usually water, is circulated internally and externally of the chiller unit through a cooling medium circulating circuit 200, wherein the water undergoes thermal exchange with the refrigeration circuit in a cooler 110 for cooling the water. The cooled water is then pumped cyclically out of the chiller unit through a cooling conduit (not shown) making up the external part of the cooling medium circulating circuit 200.

Elements of the refrigeration circuit 100, with the exception of the evaporating temperature detection device (to be discussed later), are generally known and shall now be described beginning clockwise (i.e., the direction of refrigerant flow) from a compressor 140. More specifically, the refrigeration circuit 100 comprises the compressor 140, a condenser 150, an expansion valve 160, an evaporating temperature detecting device 170, such as a thermocouple or the like for sensing the evaporation temperature at a position in the refrigerant circulating path downstream from the expansion valve 170, a cooler 110, a bulb 120, and oil separator 130 and a hot gas bypass valve 180. The compressor 140 serves for compressing the refrigerant, whereas the condenser 150 removes heat from the compressed refrigerant converting it to a liquid state. The condenser 150 is typically used in conjunction with a fan 190 and/or cooling water may be supplied to the condenser 150 through a condenser cooling water line 195 which communicates with a cooling tower (not shown) or the like, as would be understood by persons skilled in the art. After passing through the condenser 150, the refrigerant passes through an expansion valve 160 where it is expanded into a gaseous state producing refrigeration. The expansion valve 160 is connected to a sensing bulb 120, wherein the expansion valve 160 and sensing bulb 120 are electrically connected (as indicated by the single dashed line) so that the sensed temperature from the bulb 120 controls operation of the expansion valve 160. More specifically, the expansion valve 160 is a refrigerant metering valve that controls the flow of expanding refrigerant into the cooler 110 by sensing the temperature from the sensing bulb 120, and for adjusting the flow of the refrigerant to maintain a predetermined condition. In place of the expansion valve 160, a capillary tube could also be used, as would be understood by persons skilled in the art. In addition, the circuit 100 includes a hot gas bypass value (HGBV) 180 which causes the circulating refrigerant to bypass the condenser and expansion valve 160 when the compressor unit 140 is operating under low thermal load conditions or upon startup, again as is well known.

The refrigerant which passes through the cooler 110 serves for chilling a cooling medium, such a water, which circulates through the cooling medium circulating circuit 200. The elements of the cooling medium circulating circuit 200 are the cooler 110, a proportional control valve 210, a pump and tank system 220, and the cooling medium outlet 30 and inlet 20 which have been discussed above in FIG. 1. It is understood that the cooling medium inlet and outlet ports 20, 30 connect to an external circulating conduit (not shown) which carries the cooling medium to a customer site location, such as a semiconductor processing station or the like, for cooling the location, with the chiller unit 10 being located in relative proximity to the location to be cooled, as has been discussed above.

The cooling medium circulating circuit 200 also includes a proportional control valve 210 and associated temperature control indicator (TCI) 230, whereby the incoming cooling water temperature is sensed and freshly cooled water from the cooler 110 is added into the cooling medium circulating circuit 200 at a mixing rate determined in proportion to the incoming cooling water temperature, so that the cooling water supplied to the exterior maintains a predetermined cooling condition.

In order to enable the primary object of the present invention, the refrigeration circuit 100 includes a temperature sensing element 170, such as a thermocouple, located at the outlet of the expansion valve 160 and before entry into the cooler 110, for detecting the evaporation temperature of the refrigerant. In addition, a second temperature sensing element 173, also a thermocouple or the like, is provided for detecting the atmospheric temperature in the vicinity of the air-intake of the condenser 150. As another alternative, or in addition to the second temperature sending element 173, a further temperature sensing element 176 may be provided for detecting the inlet temperature of the cooling water supplied to the condenser.

Figure 3:
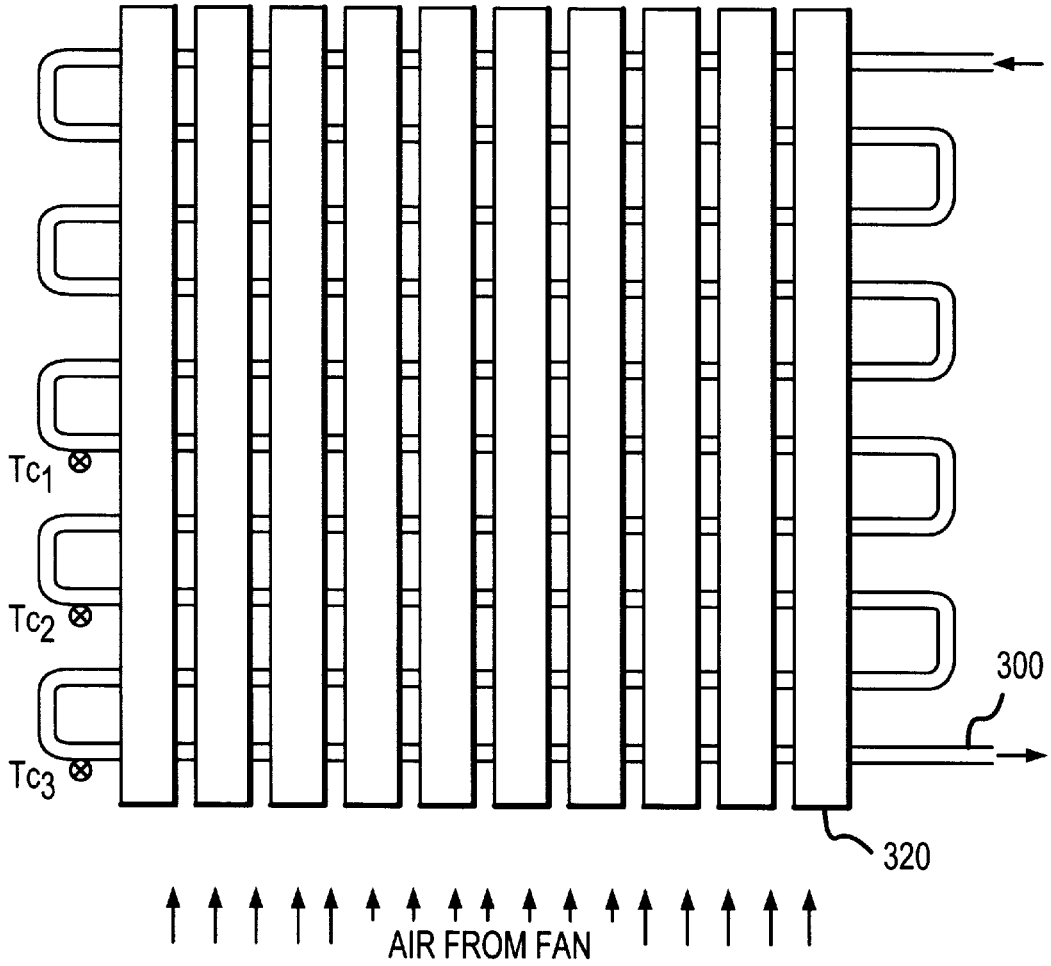
FIG. 3 is a schematic representation showing the structure of the condenser and positions of temperature sensors provided thereon.

As yet another alternative, as shown in FIG. 3, one or more temperature sensors $Tc_1$, $Tc_2$, $Tc_3$ are disposed at respective positions (typically three) along the refrigerant line 130 passing through the condenser 150, constituted by a plurality of thermal-transfer plates 320 through which the refrigerant line 130 passes in a known manner. More specifically, sensors $Tc_1$, $Tc_2$, $Tc_3$ may be disposed at positions along the refrigerant line 300 at which the refrigerant is entering or has already entered the liquid phase in the condensing stage of the refrigeration cycle.

Data of the evaporation temperature, and at least one of atmospheric temperature, condenser cooling water temperature and/or refrigerant condensing temperature, are detected and are transmitted on a periodic basis (for example, one or twice per hour, or any other suitable time interval) through a known Internet or intranet connection, or via electronic mail, telephone lines, etc., to a server monitoring and maintenance facility where the data is collected and periodically analyzed.

The analytical method for detecting a refrigerant leak shall now be explained in connection with FIG. 4.

Figure 4:
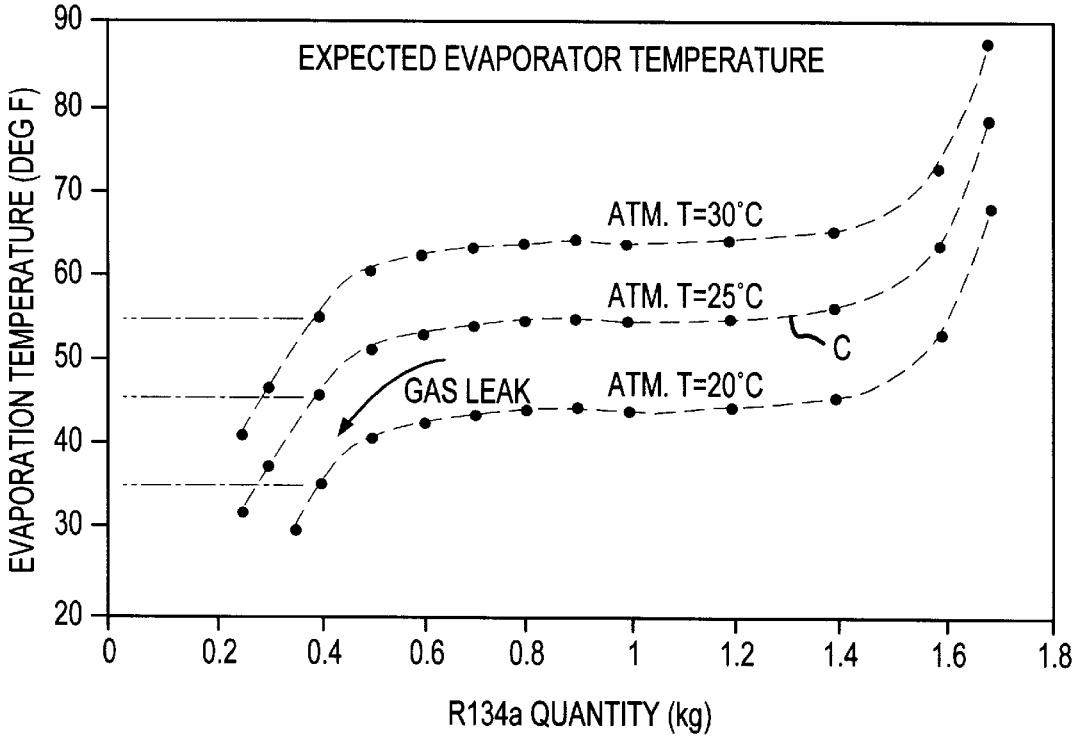
FIG. 4 is a graph showing the relationship between expected evaporator temperature to quantity of refrigerant, which is utilized for detecting a gas leak.

FIG. 4 is a graph showing the relationship between expected evaporator temperature to quantity of refrigerant, which is utilized for detecting a gas leak.

The curve C of FIG. 4 represents data that is determined empirically as a refrigerant is added to the refrigeration circuit. For example, under normal operating conditions at about 25° C. without any leaks in the refrigerant line, when the refrigeration circuit is charged with 0.4 kg of R134 a a refrigerant, a 45 of evaporation temperature is detected, and when 0.2 kg more of refrigerant is added so that the charged amount is 0.6 kg, then the evaporation temperature rises to about 50 of. Generally, about 0.8 kg of refrigerant gas is charged in the chiller unit for normal operation.

After that, on the basis of the empirically derived curve C, if the refrigerant in the chiller unit 10 decreases as a result of a gas leak, then the evaporation temperature will decrease accordingly following this curve.

As illustrated by curve C in FIG. 4, a gas leak can be detected to have occurred when the evaporating temperature of the refrigerant, as detected by a thermocouple 170 (see FIG. 2) for example, falls below about 45 of at 25° C. However, in addition, by understanding the basic form of the curve C shown in FIG. 4, it is also possible to determine a trend in the data so that, in particular, as the evaporating temperature data is collected over time, stored and analyzed at the server monitoring and maintenance facility, it becomes possible to predict when the refrigerant amount approaches the descending position in curve C (indicated by the curved arrow labeled "gas leak"), and thereby predict an incipient refrigerant gas leak before it becomes a serious problem.

However, the curve C shown in FIG. 4 is also subject to shifting in the vertical direction based on atmospheric temperature in the vicinity of the chiller unit. More specifically, as shown in FIG. 4, if the atmospheric temperature rises from a room temperature of 25° C. to 30° C., the curve C is subjected to a shift upward on the vertical axis, and hence in this condition the refrigerant gas leak would be expected to occur at about 55° F. instead of 45° F. Similarly, if the atmospheric temperature drops from a room temperature of 25° C. to 20° C., the curve C is subjected to a downward shift along the vertical axis, and the refrigerant gas leak would be expected to occur at about 35° F. in accordance with the downward shifted curve.

Stated symbolically, the amount of refrigerant gas $R_{amt}$, charged in the refrigeration circuit varies dependent on the evaporation temperature $T_{evp}$ according to the following expression:

$$f(T_{evp})=R_{ami} \tag{1}$$

wherein the curve defined by $f(T_{evp})$ is shifted on the Tevp-axis dependent on atmospheric temperature $T_{atm}$.

Normally, with a hermetic or closed-circuit refrigeration cycle 100 as described, when the external atmospheric temperature or the cooling medium temperature decreases, the condenser pressure is lowered, and as a result thereof, the refrigerant capacity increases. At a fixed load, even considering the effect of evaporation, the refrigerant capacity also increases by the fact of lowering of the condensation temperature of the refrigerant, and the evaporation temperature of the refrigerant is also lowered.

Stated otherwise, it is not possible to accurately determine a refrigerant gas leak on the basis of the trend expected from curve C using only evaporation temperature, but rather, knowledge of the atmospheric temperature (or alternatively the condenser cooling water temperature or the refrigerant condensing temperature, which also reflect atmospheric temperature) is essential as well. Thus, the refrigerant gas leak can reliably be detected only on the basis of the relationship between refrigerant quantity, evaporation temperature and at least one of atmospheric temperature, condenser cooling water temperature or refrigerant condensing temperature.

It shall be understood that the condenser cooling water temperature and the condensing temperature of the refrigerant in the condenser 150 may also serve as a basis for detecting an operational temperature of the cooling environment, and that the curve C shown in FIG. 4 is also subject to a similar vertical shifting based on condenser cooling water temperature or the refrigerant condensing temperature, similar to the case of atmospheric temperature. Thus, the condenser cooling water temperature, as measured by temperature detector 176, can also serve in place of atmospheric temperature, or both values may be used for greater accuracy, if desired. As another alternative, the refrigerant condensing temperature in the condenser 150, as measured by the temperature sensors $Tc_1$, $Tc_2$, $Tc_3$ shown in FIG. 3, could also be used in a similar manner. Although the effect of the shifting is essentially the same, and is accounted for analogously to atmospheric temperature as shown in FIG. 4, the degree of shifting of the curve C may vary depending on the method used.

It should also be appreciated that, unlike the case of an automobile, the present invention is intended for operation with industrial equipment and a chiller unit which is a small scale portable refrigeration device, wherein the temperature conditions at the customer site can be expected to be substantially constant, and not subjected to widely fluctuating temperature and humidity conditions and the like. The substantially stable temperature conditions in which the chiller units are used makes the leak detection method of the present invention feasible, as the temperature dependent data (i.e., shifting of the curve C shown in FIG. 4) can be handled in a predictable manner.

Figure 5:
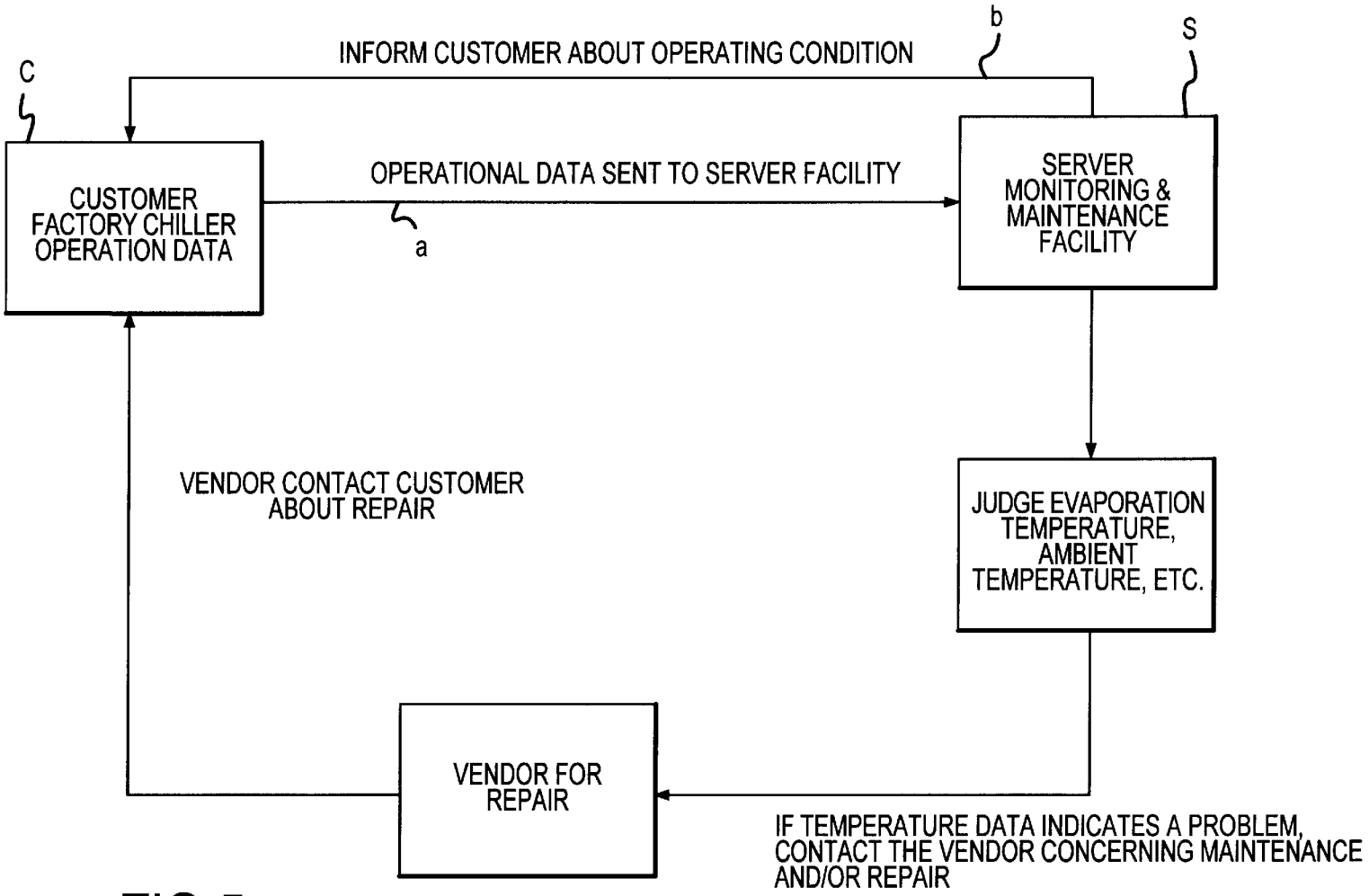
FIG. 5 is a flow chart for explaining operation of a system for conducting remote maintenance of chiller data according to the present invention.

FIG. 5 is a flowchart describing the transmittal and flow of data between the remote location or customer site at which the chiller unit is located and the server monitoring and maintenance facility. Typically, the server monitoring and maintenance facility will be administered by the company which manufactures the chiller units in association with vendors who sell and service the units.

The system, as shown, includes a customer site C which is typically a manufacturing site or factory, and a server site S which maintains a server capable of establishing bi-directional communications (indicated by transmission channels a and b) with the customer site C, over the Internet, via electronic mail, through a dedicated intranet, telephone lines, or the like. In particular, the server site S receives operational data of the chiller unit 10 along a transmission channel a, including evaporation temperature in the chiller unit, and at least one of the detected atmospheric temperature, cooling water temperature, and/or condensing temperature as discussed above. At the server site S, the chiller data is monitored periodically according to a schedule which may be once or twice per hour. A return message is transmitted along a transmission channel b from the server site S to the customer site C, also periodically, to inform the customer about the operational condition of the chiller unit. Assuming no problems are detected, the customer is simply informed of this fact, and no repair measures are taken.

The collected data is analyzed on the basis of the curve C shown in FIG. 4 while taking into account not only evaporation temperature but also shifting of the curve due to at least one of atmospheric temperature, cooling water temperature and refrigerant condensing temperature.

More specifically, customer data shall be collected and monitored continuously by a computer, wherein the data is sampled only once per hour or once every thirty minutes, and therefore the volume of data is not particularly large. The data is compared with initial data which is determined in advance on the basis of the curves and trends shown in FIG. 4. That is, expected evaporation temperature data based on the customer site, taking into account atmospheric temperature, is made available as initial data. The initial data values for the evaporation temperature are provided at each of a plurality of atmospheric temperature values. For example, in the case of the values shown in FIG. 4, a stored data table may be provided in which an expected initial value indicating a full charge of 0.8 kg of refrigerant gas provides an initial expected evaporation temperature of between 45 of and 55 of at an atmospheric temperature of 25° C., of between 55° F. and 65° F. at an atmospheric temperature of 30° C., and of between 35° F. and 45° F. at an atmospheric temperature of 20° C., and so forth.

Next, if the result of the comparison indicates that the collected data agrees with the initial data, at the detected atmospheric temperature, then the collected data is logged without further intervention. On the other hand, if the results of the comparison indicate that some of the data is not in conformity with the initial data, then such data is marked and displayed prominently (for example in red) on a computer display. At this point, other alarms may be provided to alert the staff at the server and maintenance facility S to more carefully compare and investigate the problem data. The problem data is also logged.

If the monitoring and analysis indicates that a refrigerant leak is beginning to appear or is in progress, then the customer is so informed along transmission channel b. At the same time, if the temperature data indicates a problem, a vendor V who is near to the customer site C can be contacted, wherein the vendor V in turn contacts the customer C and arrangements are made to dispatch servicing personnel to the customer site C for repairing the chiller unit, which would typically involve detecting the source of the leak, repairing it and recharging the unit with refrigerant.

It shall be understood that various modifications to the present invention will be apparent and can be readily made by persons skilled in the art without departing from the scope and spirit of the present invention. Accordingly, the following claims shall not be limited by the descriptions or illustrations set forth herein, but shall be construed to cover with reasonable breadth all features which may be envisioned as equivalents by those skilled in the art.

What is claimed is:

1. A method for monitoring a refrigeration unit installed at a remote site, for detecting a refrigerant gas leak or refrigerant insufficiency therein over a network, comprising the steps of:

detecting an evaporation temperature of a refrigerant gas in a refrigeration circuit of said refrigeration unit to provide evaporation temperature data;

detecting at least one of an atmospheric temperature in the vicinity of a condenser in said refrigeration device, the temperature of a cooling medium supplied to said condenser, and a refrigerant condensing temperature in said condenser, to provide atmospheric temperature data;

transmitting periodically said evaporation temperature data and said atmospheric temperature data to a server monitoring and maintenance facility over said network;

monitoring said evaporation temperature data and said atmospheric temperature data; and contacting personnel at said remote site if said evaporation temperature data falls below a predetermined level at a predetermined atmospheric temperature value indicated by said atmospheric temperature data.

2. The method according to claim 1, wherein an amount of refrigerant gas $R_{amt}$ charged in said refrigeration circuit varies dependent on said evaporation temperature $T_{evp}$ according to an expression defined by $f(T_{evp})=R_{amt}$, and wherein said expression is shifted on the $T_{evp}$-axis dependent on said atmospheric temperature $T_{atm}$.

3. The method according to claim 1, wherein said step of monitoring comprises:

providing expected initial values for said evaporation temperature at each of a plurality of atmospheric temperatures;

comparing said evaporation temperature data with the initial values which correspond to the atmospheric temperature data; and marking said evaporation temperature data which deviate from said expected initial values.

4. The method according to claim 3, wherein said marking comprises displaying said evaporation temperature data on a monitor, wherein said temperature data which deviate from said expected initial values are displayed in a different color from evaporation temperature data which does not deviate from the expected initial values.

5. The method according to claim 1, wherein said refrigeration unit is installed at said remote site which is a substantially constant temperature environment.

6. A system for monitoring a refrigeration unit installed at a remote site, for detecting a refrigerant gas leak or refrigerant insufficiency therein over a network, comprising:

a refrigeration unit having a refrigeration circuit and a cooling medium circulating circuit operatively positioned for thermal transfer therebetween;

a first temperature sensor for detecting an evaporation temperature of a refrigerant gas in said refrigeration circuit to provide evaporation temperature data;

at least one additional temperature sensor for detecting at least one of an atmospheric temperature in the vicinity of a condenser in said refrigeration device, the temperature of a cooling medium supplied to said condenser, and a refrigerant condensing temperature in said condenser, to provide atmospheric temperature data;

a bi-directional communications network for transmitting periodically said evaporation temperature data and said atmospheric temperature data to a server monitoring and maintenance facility over said network, as well as transmitting data concerning operation of said refrigeration unit to said remote site;

means for monitoring said evaporation temperature data and said atmospheric temperature data at said server monitoring and maintenance facility, and for indicating evaporation temperature data which falls below a predetermined level at a predetermined atmospheric temperature value indicated by said atmospheric temperature data.

7. The system according to claim 6, wherein an amount of refrigerant gas $R_{amt}$ charged in said refrigeration circuit varies dependent on said evaporation temperature $T_{evp}$ according to an expression defined by $f(T_{evp})=R_{amt}$, and wherein said expression is shifted on the $T_{evp}$-axis dependent on said atmospheric temperature $T_{atm}$.

8. The system according to claim 6, wherein said means for monitoring comprises:

a stored data table containing expected initial values for said evaporation temperature at each of a plurality of atmospheric temperatures;

means for comparing said evaporation temperature data with the initial values which correspond to the atmospheric temperature data; and means for marking said evaporation temperature data which deviate from said expected initial values.

9. The system according to claim 8, wherein said means for marking comprises a display means for displaying said evaporation temperature data on a monitor, and wherein said temperature data which deviate from said expected initial values are displayed in a different color from evaporation temperature data which does not deviate from the expected initial values.

10. The system according to claim 6, wherein said refrigeration unit is installed at said remote site which is a substantially constant temperature environment.

11. The system according to claim 6, wherein said refrigeration circuit includes at least one of an expansion valve and a capillary tube for expanding said refrigerant, wherein said first temperature sensor is disposed substantially adjacent to and in contact with a refrigerant line at a position downstream from said expansion valve or said capillary tube.

12. The system according to claim 11, wherein said at least one additional temperature sensor is disposed in the vicinity of an air intake of said condenser, for providing the atmospheric temperature in the vicinity of said condenser.

13. The system according to claim 11, wherein said at least one additional temperature sensor is disposed substantially adjacent to and in contact with a cooling medium line for supplying a cooling medium to said condenser, for providing a condenser cooling medium temperature.

14. The system according to claim 11, wherein said at least one additional temperature sensor is disposed substantially adjacent to and in contact with the refrigerant line at a position where said refrigerant line passes through said condenser, for providing a refrigerant condensing temperature.

* * * * *